US010512928B2

(12) United States Patent
Moretti

(10) Patent No.: US 10,512,928 B2
(45) Date of Patent: Dec. 24, 2019

(54) FLUID SUBSTANCE DISPENSING DEVICE

(71) Applicant: LUMSON S.p.A., Capergnanica (CR) (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 0 days.

(21) Appl. No.: 16/037,051

(22) Filed: Jul. 17, 2018

(65) Prior Publication Data

US 2019/0022681 A1 Jan. 24, 2019

(30) Foreign Application Priority Data

Jul. 19, 2017 (IT) ..... 102017000082234

(51) Int. Cl.
*B05B 11/00* (2006.01)

(52) U.S. Cl.
CPC .... *B05B 11/3047* (2013.01); *B05B 11/00412* (2018.08); *B05B 11/3015* (2013.01); *B05B 11/00416* (2018.08)

(58) Field of Classification Search
CPC ..... B05B 11/3015; B05B 11/3047; B05B 11/00412; B05B 11/00416
See application file for complete search history.

(56) References Cited

U.S. PATENT DOCUMENTS 5,108,013 A * 4/1992 VanBrocklin ..... B05B 11/3018 222/321.2
5,277,340 A * 1/1994 Van Brocklin ..... B05B 11/0013 222/321.7
5,509,584 A * 4/1996 Gueret ..... B05B 11/0013 222/207
5,642,908 A * 7/1997 Mascitelli ..... B05B 11/3049 222/321.7

(Continued)

FOREIGN PATENT DOCUMENTS

DE 202005014895 U1 8/2006
EP 2153908 A1 2/2010

(Continued)

OTHER PUBLICATIONS

Search Report and Written Opinion dated Mar. 21, 2018 for Italian patent application No. 102017000082234.

*Primary Examiner* — Frederick C Nicolas
(74) *Attorney, Agent, or Firm* — Vorys, Sater, Seymour and Pease LLP

(57) ABSTRACT

A fluid substance dispensing device including a container provided with an opening providing access to the interior thereof, and a dispensing pump associated with the container to dispense a fluid substance, which may be contained inside the container, and a sealing element positioned between the container and the pump, the sealing element including a flange abutting with a clear surface of the container perpendicular to a longitudinal axis of the container: the sealing element furthermore includes a first tubular wall which (Continued)

extends inside the container and creates a seal one an internal surface thereof, the sealing element furthermore including a second tubular wall which extends inside the container 2 and creates a seal with an external cylindrical surface of a body of the pump positioned inside the container.

12 Claims, 2 Drawing Sheets

(56) References Cited

U.S. PATENT DOCUMENTS 6,073,805 A * 6/2000 Gueret ..... B05B 11/0013 222/95
6,279,786 B1 * 8/2001 de Pous ..... B05B 11/0013 222/321.9
6,527,149 B1 * 3/2003 Garcia ..... B05B 11/0013 222/321.9
6,592,010 B2 * 7/2003 Plessis ..... B05B 11/0013 222/321.9
6,641,001 B2 * 11/2003 Beranger ..... B05B 11/3049 222/321.9
6,666,355 B2 * 12/2003 Padar ..... B05B 11/0044 222/152
6,945,428 B2 * 9/2005 Shimizu ..... B65D 1/0215 222/105
7,021,495 B2 * 4/2006 De Laforcade ..... B05B 11/0059 222/105
7,134,577 B1 * 11/2006 Verma ..... B05B 11/0037 222/321.9
7,134,578 B2 * 11/2006 Bougamont ..... B05B 11/0013 222/321.9
8,534,506 B2 * 9/2013 Bohnisch ..... B05B 11/3047 222/321.9
8,544,690 B2 * 10/2013 Garcia ..... B05B 11/0013 222/147
2007/0007307 A1 1/2007 Bohnisch et al.
2013/0161341 A1 6/2013 Kneer

FOREIGN PATENT DOCUMENTS

EP 2243557 A1 10/2010
EP 2585377 5/2013
FR 2827844 A1 1/2003
WO 0126822 A1 4/2001
WO 2005016551 A1 2/2005

* cited by examiner

FLUID SUBSTANCE DISPENSING DEVICE

CROSS REFERENCE TO RELATED APPLICATION

This claims the benefit of Italian patent application no. 102017000082234, filed Jul. 19, 2017, hereby incorporated by reference in its entirety.

FIELD OF THE INVENTION

The present invention relates to a fluid substance dispensing device.

In particular, it relates to a device for dispensing fluid substances by means of a hermetic manual pump, associated with a container made of plastic, inside which a deformable bag may be integrally formed.

BACKGROUND ART

The prior art envisages the use of hermetic manual pumps which are associated with containers inside which a fluid substance is present. Operation of the pump results in the dispensing of the fluid.

In pumps of the hermetic type, the amount of fluid dispensed is not replaced by air coming into the container from which the fluid is dispensed. Therefore, the container usually features a deformable bag which deforms as a consequence of the dispensing of the fluid via the pump. Instead of the deformable bag, a movable container base may be envisaged.

One drawback of these types of devices relates to the use of a flat annular gasket, which is usually interposed between the neck of the container (at the head) and a pump flange.

More specifically, with the use of conventional gaskets, it proves difficult to obtain a constant seal over time, especially when the said seal must be maintained even in depressurised conditions resulting from the partial emptying of the bag containing the fluid substance.

The various factors that negatively influence the possibility of obtaining a constant seal include the non-flatness of the mouth of the vial, especially in the event that the vial or container is made of plastic.

Another factor which negatively influences the seal is the 'memory' effect of the gasket, which is particularly accentuated when the inside of the container is subjected to inconstant depressurisation.

Last but not least, it proves complex, and sometimes impossible, to obtain a constant seal over time in the event of a snap (and therefore not threaded) coupling between the pump and the container. In this event, it proves difficult to adjust the pre-load on the gasket (which is obtained more easily, meanwhile, with a threaded coupling).

WO 01/26822-A1 describe a seal configured for non-hermetic pumps. The seal performed is not an air-tight seal and only works when the seal itself undergoes a deformation induced by the position of the pump.

Also, the seal described in EP 2 153 908-A1 works only in 'deformed' conditions. Furthermore, the seal of the cited reference, works only to prevent air to enter the container, and allows fluid to leak from the container, when the pump is fitted on it.

DE 20 2005 014895-U1 also describe a seal known in the art.

SUMMARY OF THE INVENTION

The object of the present invention is to provide a fluid substance dispensing device which is improved compared with the prior art.

A further object of the invention is to provide a device which improves the seal between a container and the pump, even in the event of a plastic container associated with a hermetic pump.

A further but not final object of the present invention is to provide a device which improves the seal even in the presence of snap couplings, whether direct or indirect, between the pump and the container.

This and other objects are achieved by means of a fluid substance dispensing device produced according to the technical teachings of the claims annexed hereto.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

Figure 1:
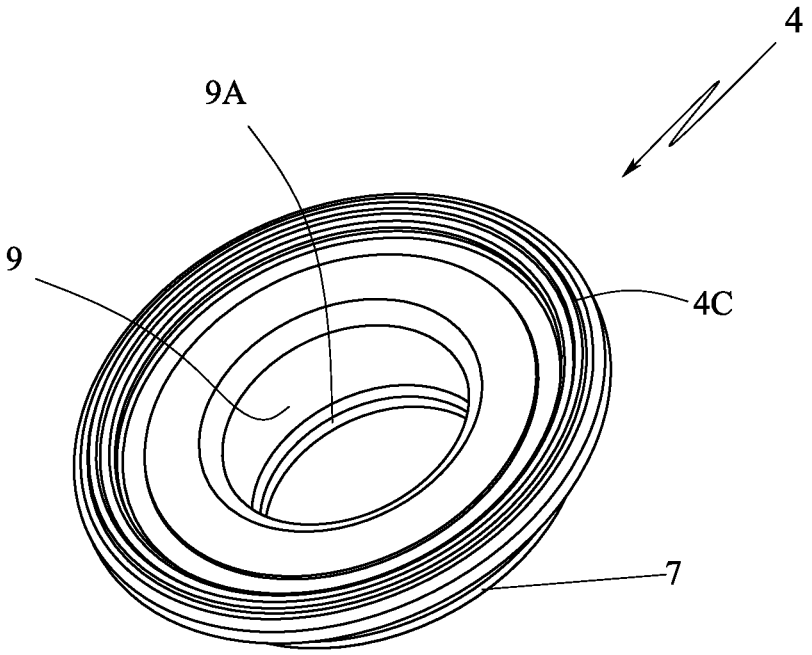
FIG. 1 is a perspective view of a sealing element forming part of the device according to the present invention.

With reference to the figures stated, reference number 1 is used to denote, as a whole, a fluid substance dispensing device.

The fluid substance dispensing device 1 comprises a container 2 provided with an opening 6 to access the interior thereof.

In the present wording, the term "fluid substance" refers to a substance with a liquid or creamy consistency, which may be, for example, a cosmetic cream, a perfume, a medicine, a gel, a lacquer, a hair product, etc.

The container 2 may feature a neck 8 delimiting an opening 6 permitting access to a cavity 2C in the said body.

In the figures shown, the neck 8 has a smaller diameter than that of the rest of the container, but it is also possible to use vials, bottles etc., with a neck which is essentially flush with the external wall of the recipient, so that the section of the opening delimited by the neck is similar to the maximum internal diameter of the recipient.

The container 2 may be made by plastic-blowing.

The said container may also envisage, inside thereof and formed integrally therewith, a deformable bag 2A whose interior is accessible through the opening 6. The container 2 and the bag 2A may be produced as described in patent documents EP 2,585,377-A1.

A compartment 2D may be envisaged between the container and the bag and in communication with the exterior, for example by means of at least one hole made in the bottom of the container, in a not very visible part.

When pressurised air is introduced into the compartment 2D, the bag detaches from the internal wall of the container surrounding the said bag. Furthermore, the holes allow air to enter the compartment 2D while the bag is emptying.

To dispense the product contained in container 2, a manual pump 3 is associated therewith.

The manual pump is of the hermetic type (also known as airless). A hermetic manual pump allows the product to be dispensed while preventing air coming into contact with the remaining product to be dispensed inside the container, which therefore remains intact and sealed off.

A sealing element 4 is envisaged between the container and the pump. The sealing element 4 is preferably formed as a single piece and is shown separately from the container, in FIGS. 1 and 2. The said element comprises a flange 5 which, during use, abuts with a free surface of the container 2, and—more specifically—a surface delimiting the opening 6. The said surface is substantially perpendicular to a longitudinal axis of the container 2.

The sealing element 4 furthermore comprises a first tubular wall 7 which extends inside the container (FIG. 3) and creates an air-tight seal with an internal surface thereof 20.

The internal surface 20 of the container may be an essentially cylindrical internal surface, which delimits and/or defines the opening 6.

The sealing element 4 furthermore comprises a second tubular wall 9 which extends inside the container 2 and creates a seal with an external cylindrical surface 21 of a body 3A of the pump positioned inside the container 2.

To create the seal, the first tubular wall 7 may be configured to provide a sealed air-tight coupling with the internal cylindrical surface of the container. The free edge 22 of the first tubular wall may be tapered (sectional view) to facilitate the insertion of the element 4 into the opening 6 and the centring thereof.

The second tubular wall 9 may comprise a sealing lip 9A cooperating with the external surface of the body 3A of the pump 3, to form an air-tight seal.

It should be noted that the air-tight seal performed by the first 7 and the second tubular wall 9 prevents air and fluid substance both to enter and to leave the container.

Moreover, the first 7 and the second tubular wall 9, are configured to perform their air-tight seal even when a part 4A of the seal is undeformed. The seal may be performed even without deformation of the part 4A, because the tubular configuration of the first and of the second walls is sufficient to permit an air-tight seal. In fact the sole deformation of the tubular walls is enough to perform the seal.

This allows the seal to be obtained also when the pump is snap fitted to a collar 10, that is itself snap fitted to a neck 8 of the container.

Figure 2:
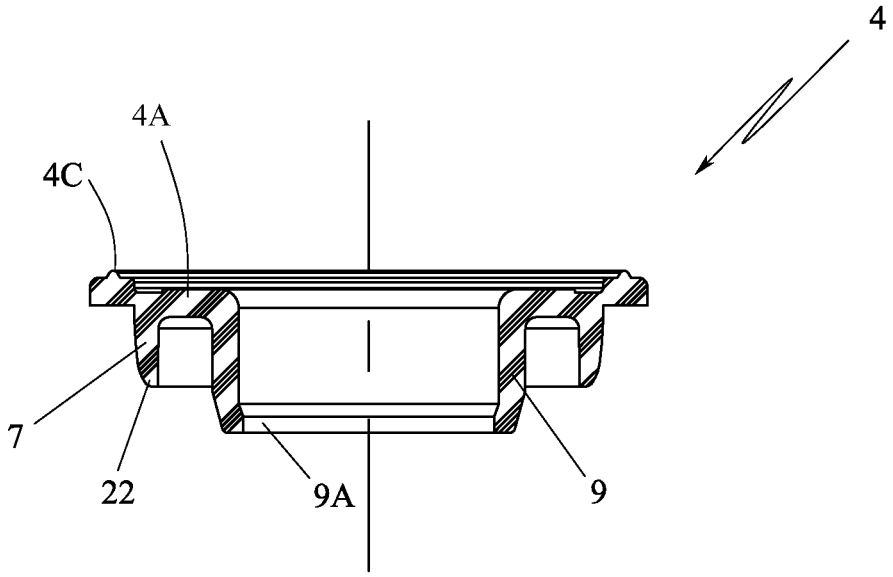
FIG. 2 is a diametral section of the element in FIG. 1.

Furthermore, the flange 5 may feature an annular rim 4C extending therefrom in the opposite direction to the container 2 (i.e. upwards in FIG. 2). The rim 4C improves the seal between the gasket and the pump on a circular surface with a limited area, making it easier to offset any unfavourable tolerances.

The rim 4C may help to perform a seal, as the flange 5 is sandwiched between the collar 10 and the free surface of the neck 8.

Figure 3:
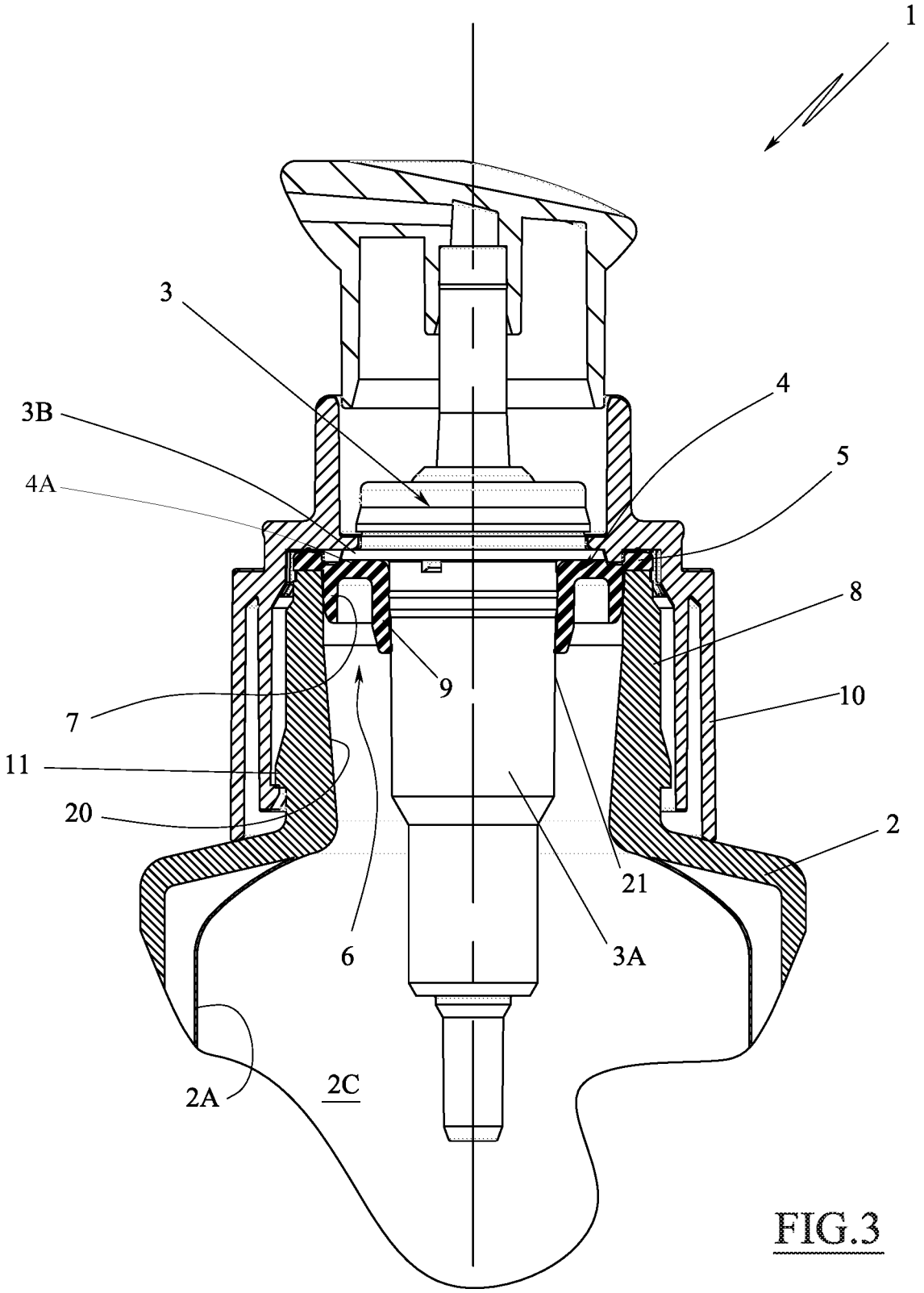
FIG. 3 is a simplified axial section of a device according to the present invention.

As already mentioned, the sealing element 4 may, preferably, be made by moulding plastic and forming a single piece. Materials which may be used to produce the sealing element 4 include: PE-LDPE-HDPE-PP-GOMMA-TPU-TPE-EVA-SILICONE As can be seen in FIG. 3, the pump 3 may feature a flange 3B resting on the undeformed part 4A of the sealing element 4, and the flange pump 3B may also have a diameter which is even smaller than that of the container opening.

This way, the sealing element 4 can act as an adapter, allowing the same type of pump to also be used for containers 2 with openings with different diameters.

In order to permanently secure the pump 3 and the sealing element 4 to the container 2, a collar 10 may be envisaged which is fixed externally to the container 2, for example to a neck 8 thereof.

The collar may be engaged with the container 2, via snap-fitting, for example, onto a protrusion 11 formed on the external surface of a neck 8 of the container.

It is also possible to envisage a collar 10 which screws onto a thread provided specifically therefore on the container 2.

It should be noted that, with respect to the conventional seals created using a flat annular gasket, the sealing element moves the sealing action onto the internal surface, in proximity to the opening of the container 2 and the external surface of the pump body. This way, the seal is independent of the locking pressure of the snap fit or thread (if featured).

Furthermore, the seal is also independent from the deformation of the gasket, and especially of that part 4C of the gasket connecting the first and the second tubular element.

The provision of a connecting part 4C that does not undergo deformation, makes this part 4C useful as a support member for a flange of the pump.

The invention is particularly advantageous in the event that the container 2 (or part thereof, such as the bag 2A, which is possibly replaceable with a movable bottom) is depressurised.

Various embodiments of the innovation have been disclosed herein, but further embodiments may also be conceived using the same innovative concept.

The invention claimed is:

1. A dispensing device of a fluid substance, comprising a container provided with an opening to access an interior of the container, and a dispensing pump of hermetic type, coupled with the container to deliver the fluid contained inside the container, and a sealing element positioned between the container and the pump, the sealing element comprising a flange resting against a free surface of the container perpendicular to a longitudinal axis of the container, wherein the sealing element comprises a first tubular wall extending internally to the container and achieving an air-tight seal on an internal surface of the container, the sealing element further comprising a second tubular wall extending internally to the container and which engages an outer cylindrical surface of a body of the pump positioned internally to the container, the first and second tubular wall being configured to perform an air-tight seal when a part of the sealing element connecting the first and the second tubular element is undeformed, wherein the pump comprises a flange resting on an undeformed part of the sealing element.

2. The device according to claim 1, wherein the first tubular wall is configured to provide a sealed conical coupling with the inner surface of the container.

3. The device according to claim 1, wherein the second tubular wall comprises a sealing lip cooperating with the outer surface of the body of the pump.

4. The device according to claim 1, wherein the flange comprises an annular rim extending in a direction opposite to the container.

5. The device according to claim 1, wherein the sealing element is made in one piece.

6. The device as claimed in claim 1, wherein the container has a cavity and comprises in the cavity, obtained in a single-piece with the container, a deformable bag whose interior is accessible through said opening.

7. The device as claimed in claim 1, wherein the pump and the sealing element are coupled to the container by means of a collar snap-fitted on the container.

8. The device as claimed in claim 7, wherein the collar engages a protrusion formed on the outer surface of a container neck.

9. The device as claimed in claim 1, wherein the pump is snap-fitted on a collar and the flange of the sealing element is sandwiched between the collar and a free surface of the container.

10. A dispensing device of a fluid substance, comprising a container provided with an opening to access an interior of the container, and a dispensing pump of hermetic type, coupled with the container to deliver the fluid contained inside the container, and a sealing element positioned between the container and the pump, the sealing element comprising a flange resting against a free surface of the container perpendicular to a longitudinal axis of the container, wherein the sealing element comprises a first tubular wall extending internally to the container and achieving an air-tight seal on an internal surface of the container, the sealing element further comprising a second tubular wall extending internally to the container and which engages an outer cylindrical surface of a body of the pump positioned internally to the container, the first and second tubular wall being configured to perform an air-tight seal when a part of the sealing element connecting the first and the second tubular element is undeformed, wherein the flange comprises an annular rim extending in a direction opposite to the container.

11. A dispensing device of a fluid substance, comprising a container provided with an opening to access an interior of the container, and a dispensing pump of hermetic type, coupled with the container to deliver the fluid contained inside the container, and a sealing element positioned between the container and the pump, the sealing element comprising a flange resting against a free surface of the container perpendicular to a longitudinal axis of the container, wherein the sealing element comprises a first tubular wall extending internally to the container and achieving an air-tight seal on an internal surface of the container, the sealing element further comprising a second tubular wall extending internally to the container and which engages an outer cylindrical surface of a body of the pump positioned internally to the container, the first and second tubular wall being configured to perform an air-tight seal when a part of the sealing element connecting the first and the second tubular element is undeformed, wherein the pump and the sealing element are coupled to the container by means of a collar snap-fitted on the container.

12. The device as claimed in claim 11, wherein the collar engages a protrusion formed on the outer surface of a container neck.

* * * * *